US006713226B2

(12) United States Patent
Goddard et al.

(10) Patent No.: US 6,713,226 B2
(45) Date of Patent: Mar. 30, 2004

(54) HIGH CONTRAST PHOTOGRAPHIC ELEMENT CONTAINING A POLYHYDRAZIDE NUCLEATING AGENT

(75) Inventors: John D. Goddard, Pinner (GB); Llewellyn J. Leyshon, Watford (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/465,492

(22) Filed: Jun. 19, 2003

(65) Prior Publication Data

US 2004/0005511 A1 Jan. 8, 2004

(30) Foreign Application Priority Data

Jun. 19, 2002 (GB) ..... 0214122

(51) Int. Cl.[7] ..... G03C 1/06
(52) U.S. Cl. ..... 430/264
(58) Field of Search ..... 430/264

(56) References Cited

U.S. PATENT DOCUMENTS

| | | | | |
|---|---|---|---|---|
| 4,988,604 | A | 1/1991 | Machonkin et al. | 430/264 |
| 4,994,365 | A | 2/1991 | Looker et al. | 430/598 |
| 5,288,590 | A | 2/1994 | Kuwabara et al. | 430/264 |
| 6,171,753 | B1 | 1/2001 | Oikawa | 430/264 |
| 6,228,566 | B1 | 5/2001 | Goddard et al. | 430/434 |
| 6,245,480 | B1 | 6/2001 | Bogie et al. | 430/264 |

FOREIGN PATENT DOCUMENTS

| | | |
|---|---|---|
| EP | 1 164 413 A1 | 12/2001 |
| EP | 1 229 383 A1 | 8/2002 |

*Primary Examiner*—Hoa Van Le

(57) ABSTRACT

The present invention relates to an ultrahigh contrast photographic material comprising a support bearing a silver halide emulsion layer, containing at least one hydrazide nucleating agent in the emulsion layer and/or a hydrophilic colloid layer, wherein the nucleating agent comprises 2 to 4 hydrazide moieties which are linked directly to one another or to one another by a linking group. The material optionally contains a booster compound in the emulsion layer or hydrophilic colloid layer to enhance the ultrahigh contrast and to promote activity, or a booster compound may be present in the developer solution.

The nucleating agents show unexpectedly good nucleation and low sensitivity to variation in development conditions and their synthesis is consistent, efficient and robust.

18 Claims, No Drawings

HIGH CONTRAST PHOTOGRAPHIC ELEMENT CONTAINING A POLYHYDRAZIDE NUCLEATING AGENT

CROSS REFERENCE TO RELATED APPLICATION

This application is cross-related to French patent application No. 0207603, filed Jun. 19, 2002.

FIELD OF THE INVENTION

This invention relates to high contrast photographic silver halide materials and in particular to materials of the graphic arts type containing a hydrazide nucleating agent.

BACKGROUND OF THE INVENTION

In the field of graphic arts, an ultrahigh contrast photographic material is required for achieving satisfactory halftone dot reproduction of a continuous tone or reproduction of a line image in the process of making a lithographic printing plate. For many years these ultrahigh contrast photographic images were obtained by developing a 'lith' emulsion (usually high in silver chloride content) in a hydroquinone, low sulfite, 'lith' developer by the process known as infectious development. However, such low sulfite developers are inherently unstable and are particularly inappropriate for machine processing.

More recently an image formation system providing ultrahigh contrast where the gamma (contrast) exceeds 10 has been provided conventionally in a material wherein silver halide bearing a surface latent image is developed in the presence of a hydrazine (also known as a nucleating agent), specifically an acylhydrazine, which can be incorporated into the photographic material or into the developer. The pH of the developer solution is usually in the range 10.0 to 12.3, typically about 11.5, and the developer includes conventional amounts of sulfite, hydroquinone and possibly metol or a pyrazolidone. While such a process is better than the low sulfite 'lith' process, the developer still has a high pH requirement for it to function correctly. Such a solution is not as stable as is desirable. Additionally, high pH solutions are environmentally undesirable because of the care needed in handling and disposing of the effluent.

Unfortunately, light sensitive materials whose contrast is enhanced by the presence of a hydrazine nucleating agent show large variations in their photographic properties as the developer is exhausted or through the course of time, for example as the pH of the developer varies and in particular as the pH is lowered. The pH of the developer can vary for a number of reasons: for example, exhaustion and absorption of carbon dioxide causes the pH to drop whilst air oxidation causes the pH to rise, as can concentration through evaporation.

Also during development of silver halide materials, particularly those which use chlorobromide emulsions, there is a release of bromide locally into area of the development as a consequence of the development process to convert silver halide to elemental silver. Both of these effects can influence the development rate of the film and give rise to process unevenness or variability during the processing run. There is an overall effect which shows up as a change to the developer component levels in solution but there is also a local effect which occurs within the developing layer and is exposure dependent. These effects can also depend on the formulation of the developer used and overcoming these problems can increase tolerance to a wider range of developer formulations.

It is also known that a developer solution having a pH below 11 can be employed by using certain hydrazides active at this pH. Hydrazides proposed for such use are described, for example, in U.S. Pat. Nos. 4,278,748; 4,031,127; 4,030,925; 4,323,643; 4,988,604 and 4,994,365 and in EP-A-0 333 435. A nucleating agent containing both a hydrazide moiety and a nicotinamide moiety is disclosed in U.S. Pat. No. 5,288,590. However the use of such a nucleating agent does not entirely remove sensitivity to both bromide and pH.

A nucleating agent which comprises a dimeric molecule comprising two monomers linked by a linking group, each monomer of which (a) may be the same or different and (b) comprises a hydrazide and a nicotinamide moiety has been disclosed in U.S. Pat. No. 6,228,566. A nucleating agent comprising (a) two nicotinamide moieties, which may be the same or different, which are linked by a linking group, and (b) a hydrazide moiety linked to only one of those nicotinamide moieties, either alone or together with the nucleating agent comprising the dimeric molecule, has been described in U.S. Pat. No. 6,245,480. A nucleating agent as described in either of these two US patents in combination with a 'conventional' aryl sulfonamido aryl hydrazide is described in EP-A-1 229 383. U.S. Pat. Nos. 4,988,604 and 4,994,365 describe aryl sulfonamidophenyl hydrazide nucleating agents which are capable of high contrast development.

Developer solutions with pHs below 11 can also be used by the introduction of a contrast-promoting agent (commonly called a booster) to give adequate activity. The booster can be incorporated into the photographic layer or may be dissolved in the developer solution. The booster may be, for example, one of the boosters as described in U.S. Pat. No. 5,316,889 or an amine booster as described in U.S. Pat. Nos. 4,269,929; 4,668,605, 4,740,452 or EP-A-0 364 166. Compounds bearing different functionalities e.g. phosphonium and pyridinium, have also been shown to be active, as described in U.S. Pat. No. 5,744,279.

In the non-image areas on the processed film unwanted small dots can appear and this is called 'pepper fog'. This is due to unintentionally fogged grains developing and being amplified by the nucleation process and being rendered visible. Nucleating agents which are unstable or more active and diffuse more rapidly can result in more and larger pepper fog spots. In high contrast materials therefore a balance needs to be achieved between vigorous development and pepper fog.

Another factor to be considered is chemical spread (or image spread) which is a measure of the increase in size of developed dots or lines produced by nucleation of the edge of the image area causing development of the image boundary beyond the original exposed edge. This spread is small but measurable and can reduce the resolution of very fine lines.

A further consideration is the efficiency of synthesis of the nucleating agents and the robustness of the chemical processes used in their synthesis. It is desirable that the nucleating agents and their intermediates are formed rapidly and efficiently at all stages of the synthesis since heating and/or prolonged reaction times can have an adverse effect on their purity. Furthermore, whilst it may be desirable from the cost point of view to prepare a mixture of nucleating agents (as in U.S. Pat. No. 6,245,480) without the need for purification or separation of the nucleating agents, for regulatory purposes it is mandatory to provide a mixture wherein the proportions of components are within defined limits. When a chemical reaction produces a mixture of nucleating agents and impurities it is not always possible to ensure that the various components will be within the defined limits and thus the process, although cost effective when successful, is less robust and consistent than desired.

PROBLEM TO BE SOLVED BY THE INVENTION

The problem is therefore to provide a nucleating agent, for incorporation into a photographic material or into the developer, which gives ultrahigh contrast whilst at the same time showing less sensitivity to variations in the developing conditions, such as pH or development time, and which may be synthesised rapidly, efficiently, in a cost effective and robust manner and having consistent purity and constitution.

ADVANTAGEOUS EFFECT OF THE INVENTION

The nucleating agents for use in this invention show unexpectedly good nucleation and less sensitivity to variation in the development conditions than do conventional nucleating agents, leading to significant improvements in processing robustness. A further benefit resides in that the syntheses of the nucleating agents of this invention are more consistent, efficient and robust than those of the dimeric nucleators and mixtures of dimeric nucleating agents previously reported in the literature.

SUMMARY OF THE INVENTION

It has now been found that the objectives of the invention can be achieved by the use of a nucleating agent comprising 2 to 4 hydrazide moieties wherein the hydrazide moieties are linked directly to one another or to one another by a linking group.

According to the present invention therefore there is provided an ultrahigh contrast photographic material comprising a support bearing a silver halide emulsion layer, containing at least one hydrazide nucleating agent in the emulsion layer and/or a hydrophilic colloid layer, characterised in that the nucleating agent has the formula (I):

(I)

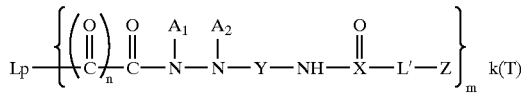

wherein each $A_1$ and each $A_2$ is independently selected from the class consisting of a hydrogen atom, an unsubstituted or substituted acyl group and an alkyl- or aryl-sulfonyl group;

each Y is independently selected from the class consisting of an unsubstituted or substituted aryl or heterocyclic ring or ring system;

each X is independently selected from the class consisting of S═O, C, C—NH and C—O;

each L' is independently selected from the class consisting of an unsubstituted or substituted alkylene group and an unsubstituted or substituted aryl or heterocyclic ring or ring system, linked to Z via an unsubstituted or substituted alkylene group, either directly or via a group selected from the class consisting of $NR_1CO$—, $NR_1CONR_2$—, $OCONR_1$— or $NR_1COO$—, wherein $R_1$ and $R_2$ are independently selected from the class consisting of a hydrogen atom and an unsubstituted or substituted alkyl group;

each Z is independently selected from an unsubstituted or substituted group, ring or ring system attached via a heteroatom selected from the class consisting of sulfur, nitrogen, oxygen or phosphorus;

each L is independently a divalent, trivalent or tetravalent linking group;

p and each n are independently 0 or 1 k is an integer from 0 to 8;

and m is an integer from 2 to 4 provided that when p is 0, n is 0 and m is 2;

when p is 1, n is 0 or 1 and m is 2, 3 or 4; and

T is a counterion or a salt forming acid.

In another aspect of the invention there is provided an ultrahigh contrast photographic material, as hereinbefore defined, which also contains in the emulsion layer or a hydrophilic colloid layer, a booster compound, as hereinafter defined.

In yet another aspect of the invention there is provided a process of forming a photographic image having ultrahigh contrast which comprises imagewise exposing a photographic material comprising a support bearing a silver halide emulsion layer and processing it with an alkaline developer solution, characterised in that it is developed in the presence of a nucleating agent of formula (I), optionally in the presence of a booster compound, as hereinafter defined

DETAILED DESCRIPTION OF THE INVENTION

The nucleating agents in accordance with this invention have the general structure as described in the Summary of the Invention.

In formula (I), each $A_1$ and each $A_2$ is independently hydrogen or an unsubstituted or substituted acyl group, such as, for example a trifluoroacetyl group, or an unsubstituted or substituted alkyl- or aryl-sulfonyl group, but preferably each $A_1$ and each $A_2$ is a hydrogen atom.

Each Y is independently an unsubstituted or substituted aryl ring or ring system, such as, for example, a phenyl or naphthyl group, or an unsubstituted or substituted heterocyclic ring or ring system, such as, for example, a pyridine, pyrrole, furan, thiophene, thiazole, imidazole, or a benzo derivative of any of these. However each Y is preferably a phenyl group, optionally substituted, for example, with from 1 to 4 substituents selected from halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quatemary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom, and a group having a tertiary sulfonium structure.

More preferably each Y is an unsubstituted phenyl group or a phenyl group substituted, for example, with an alkylthio or alkylsulfonamido group or in particular with an alkyl or alkoxy group, especially in a position ortho to the hydrazino group, or with, for example, a trifluoromethyl group, especially in a position meta to the hydrazino group.

Each X is independently selected from S═O, C, C—NH and C—O but is preferably S═O or C. When X is S═O, C—NH or C—O, L' can comprise an unsubstituted or substituted alkylene group, especially a methylene group, but it is preferred that L' comprises an unsubstituted or substituted aryl ring, preferably a phenyl ring, linked to Z via an unsubstituted or substituted alkylene group, especially a methylene group, either directly or preferably via a $NR_1CO$-group, wherein $R_1$ is a hydrogen atom or an unsubstituted or substituted alkyl group, more particularly via a NHCO-group. The aryl ring of L' may suitably be substituted, for example, with one or more alkyl, carboxyl or halogen atoms, and in particular with one or more trifluoromethyl or alkyl groups. When X is C it is preferred that L' comprises an unsubstituted or substituted alkylene group, preferably a methylene group.

Each Z is independently an unsubstituted or substituted group, ring or ring system attached via a heteroatom selected from sulfur, nitrogen, oxygen or phosphorus and may be or form with the heteroatom, for example, an alkyl group or a heterocyclic ring, such as a pyridyl or imidazolyl ring, or an alkyl-, aryl- or heterocyclyl- thio group, such as for example, a mercaptopropionic acid, mercaptopyridyl or mercaptotetrazole group or an amino, quatemary ammonium, phosphine, phosphonium, sulfonium, thioureido, isothiouronium or thiocarbamate group. Suitable substituents include, for example, an alkyl, aryl, alkylamino, dialkylamino, cyclohexenyl, piperidinyl, pyridyl, carbonamido, alkylcarbonamido or dialkylcarbonamido group, any of which may be further substituted, for example with one or more alkyl, hydroxy, pyridylcarbonamido or alkynyl groups.

More preferably Z is attached via a nitrogen or a sulfur atom and is most preferably an unsubstituted pyridyl group or a pyridyl group substituted, for example, with an alkyl, dialkylamino, cyclohexenyl, piperidinyl, pyridyl, carbonamido or alkylcarbonamido group, or Z is a thioureido, mercaptopyridyl, thiocarbamate or mercaptotetrazole, substituted, for example, with an alkyl or aryl group, any of the above groups of which may in turn be further substituted.

Each linking group L, when present, is independently selected from a divalent, trivalent or tetravalent group, such as an unsubstituted or substituted aromatic, alkylene, polyalkylene or polyalkylene oxide group or an unsubstituted or substituted alkylene or polyalkylene group separated by one or more heteroatoms selected from nitrogen, oxygen and sulfur, wherein the groups within L may also be separated from each other by one or more unsubstituted or substituted alkyl, alkylene, polyalkylene, aryl or heterocyclic groups, such as a piperidino group. Each linking group L may include, linked to each carbonyl group, a terminal oxygen atom or a group NR', wherein R' is a hydrogen atom or an unsubstituted or substituted alkyl group. Preferred linking groups are, for example, the groups $—NH(CH_2)_2NH—$, $—NH(CH_2)_6NH—$, $—(CF_2)_2—$, $—(CF_2)_3—$, $—NH(CH_2)_2O(CH_2)_2O(CH_2)_2O(CH_2)_2NH—$, $—OC_6H_4C(CH_3)_2C_6H_4O—$ and in particular the group $—NH(CH_2)$n-piperidino-$(CH_2)_nNH—$, wherein n is 0 to 4 and especially 3.

The anionic counterion may be selected from any well-known in the art and may typically be selected from $Cl^-$, $Br^-$, $CF_3CO_2^-$, $CH_3SO_3^-$and $TsO^-$or their corresponding acids HCl, HBr, $CF_3CO_2H$, $CH_3SO_3H$ and TsOH. k is an integer from 0 to 8, preferably from 0 to 4.

When p and each n are 0, then m is 2 and the compound of formula (I) is of the oxalyl-type, typified by nucleator I-29. When p is 1, i.e. there is a linking group between the carbonyl groups, and each n is independently 0 or 1, then m is either 2, 3 or 4 and is typified by nucleator I-1.

Although for ease of synthesis it may be convenient for the nucleator to be symmetrical, asymmetrical nucleating agent structures are specifically within the scope of this invention.

As used herein and throughout the specification unless where specifically stated otherwise, the term "alkyl" refers to a saturated or unsaturated, straight or branched chain alkyl group including alkenyl and aralkyl, and includes cyclic groups, including cycloalkenyl, having 3–8 carbon atoms. The term "polyalkylene" refers to an alkylene group $(CH_2)_n$ wherein n is more than 10 and the term "aryl" includes fused aryl.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy and 2-dodecyl-oxyethoxy; aryl such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy) butyramido, alpha-(3-pentadecylphenoxy)hexanamido, alpha- (4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl and N-acetyl-N-dodecylamino, ethoxycarbonylamino, phenoxycarbonylamino, benzyloxycarbonylamino, hexadecyloxycarbonylamino, 2,4-di-t-butylphenoxy-carbonylamino, phenylcarbonylamino, 2,5-(di-t-pentylphenyl) carbonylamino, p-dodecylphenylcarbonyl amino, p-toluylcarbonyl amino, N-methylureido, N,N-dimethylureido, N-methyl-N-dodecylureido, N-hexadecylureido, N,N-dioctadecylureido, N,N-dioctyl-N'-ethylureido, N-phenylureido, N,N-di-phenylureido, N-phenyl-N-p-toluylureido, N-(m-hexadecylphenyl)ureido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino and hexadecylsulfonamido; sulfamoyl, such as N-methyl-sulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl and N-dodecylsulfamoyl; carbamoyl, such as N-methylcarbamoyl, N,N-dibutyl-carbamoyl, N-octadecylcarbamoyl, N-[4-(2,4-di-t-pentylphenoxy)butyl]-carbamoyl, N-methyl-N-tetradecylcarbamoyl and N,N-di-octylcarbamoyl; acyl, such as acetyl, (2,4-di-t-amylphenoxy)acetyl, phenoxycarbonyl, p-dodecyloxy-phenoxycarbonyl, methoxycarbonyl, butoxycarbonyl, tetradecyloxycarbonyl, ethoxycarbonyl, benzyloxycarbonyl, 3-pentadecyloxycarbonyl and dodecyl-oxycarbonyl; sulfonyl, such as methoxysulfonyl, octyloxysulfonyl, tetradecyl-oxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyloxy, such as dodecylsulfonyloxy and hexadecyl-sulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclohexylcarbonyloxy; amino, such as phenylanilino, 2-chloroanilino, diethylamino and dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Specific examples of nucleators falling under the scope of the invention are shown below:

I-1

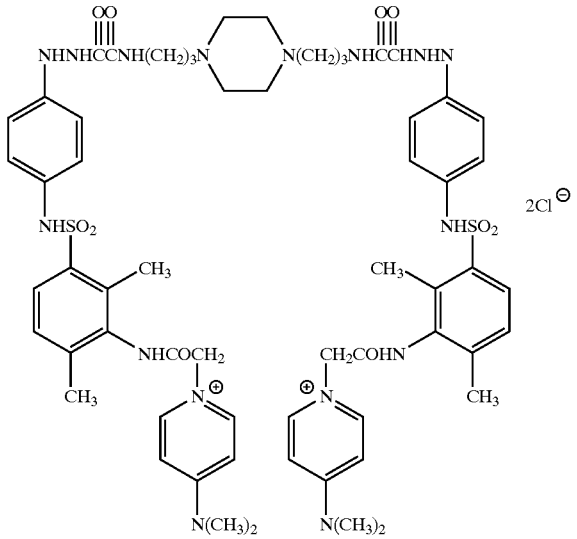

-continued

I-2

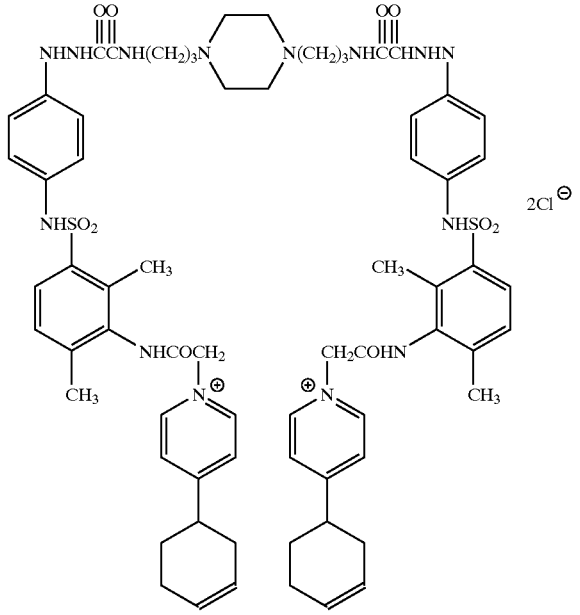

I-3

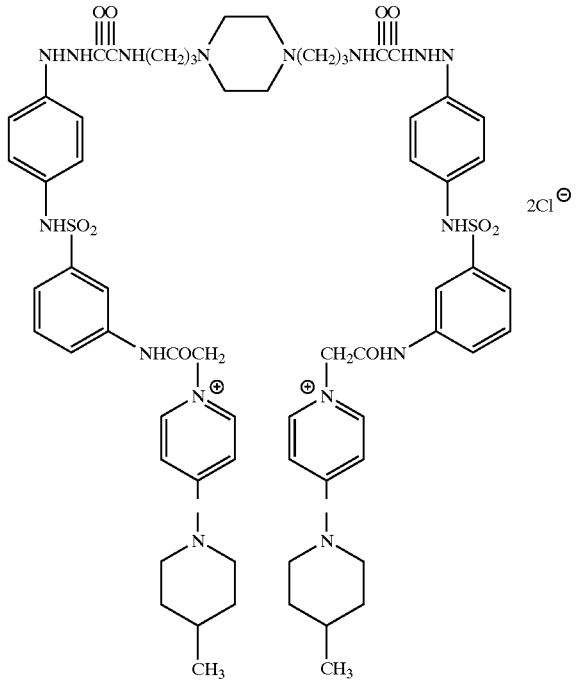

-continued
I-4
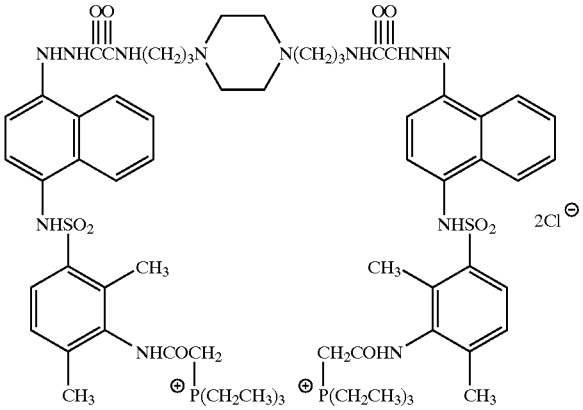
I-5
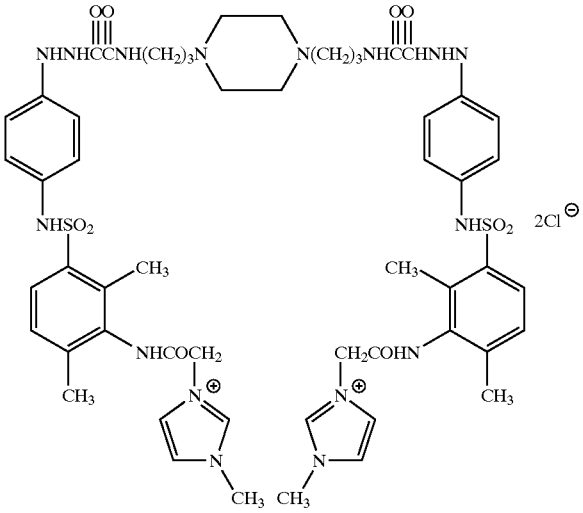
I-6
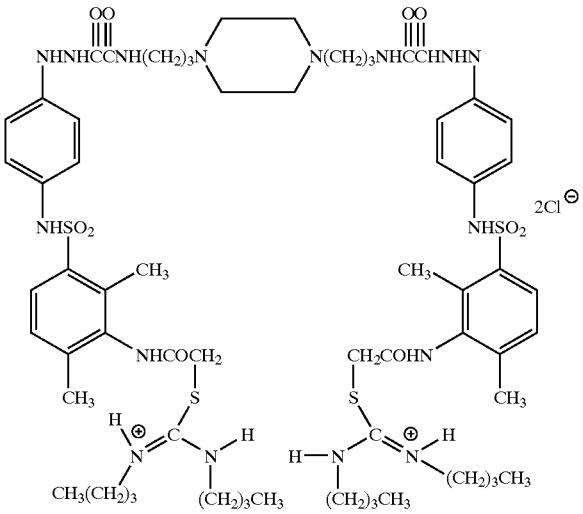
-continued
I-7
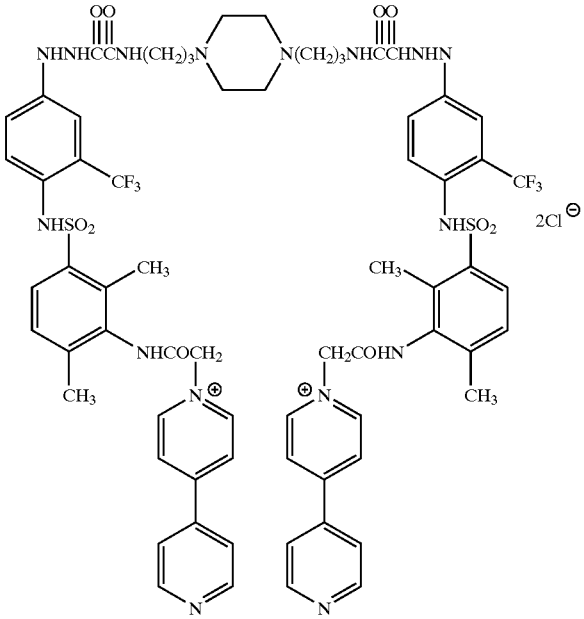
I-8
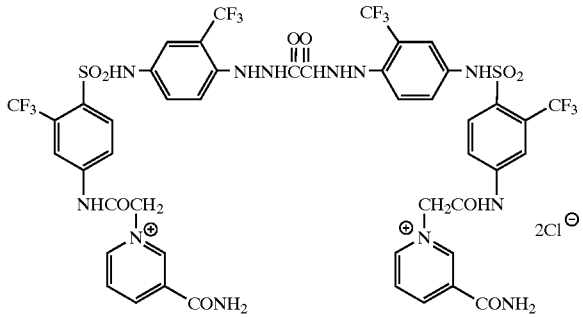
I-9
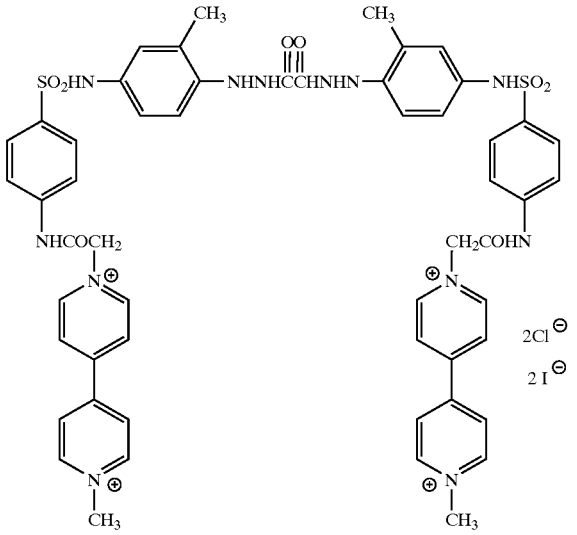

-continued
I-10
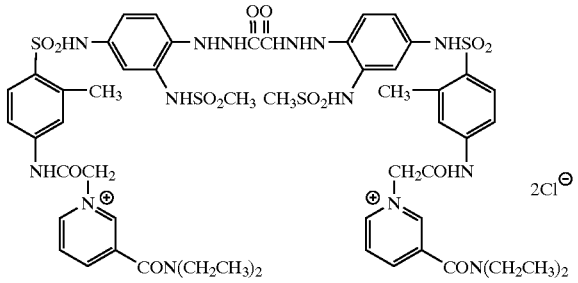
I-11
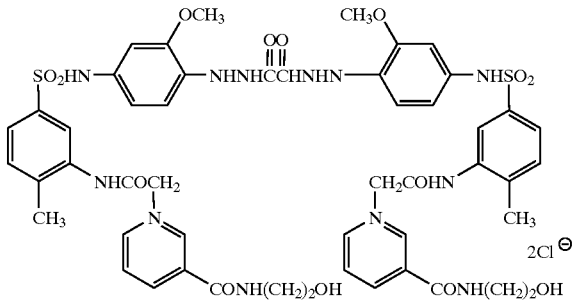
I-12
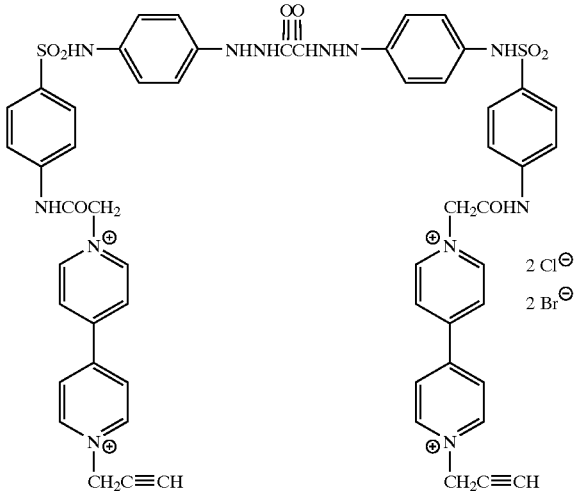
I-13
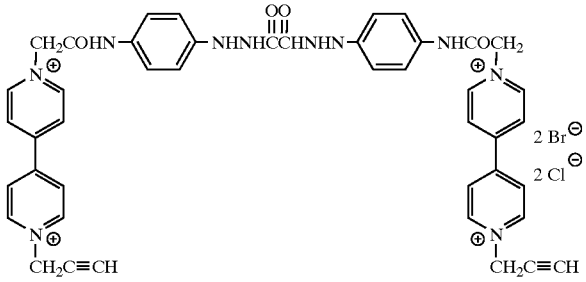
-continued
I-14
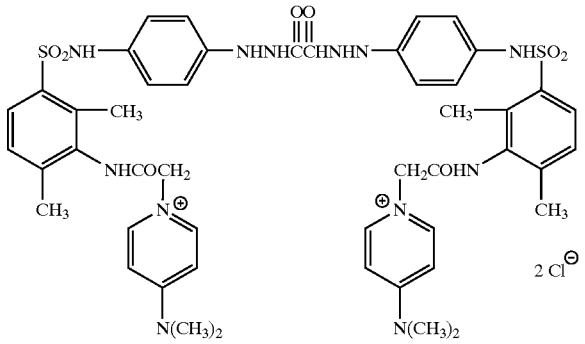
I-15
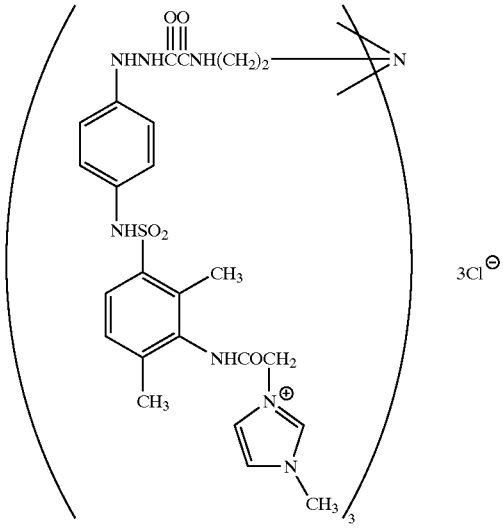
I-16
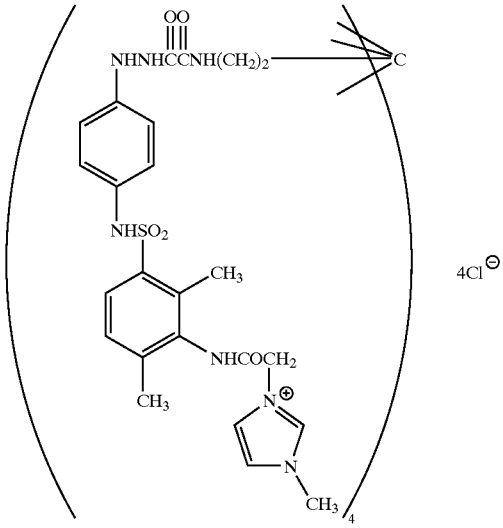

-continued
I-17
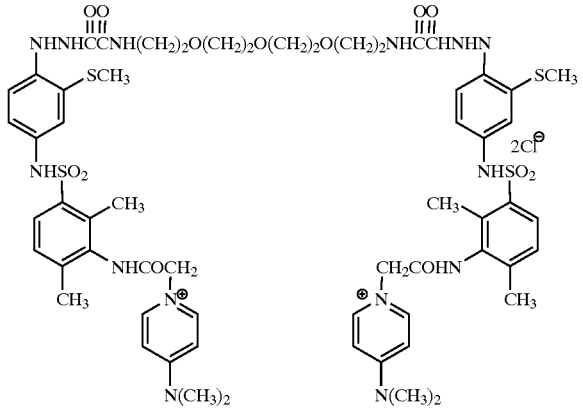
I-18
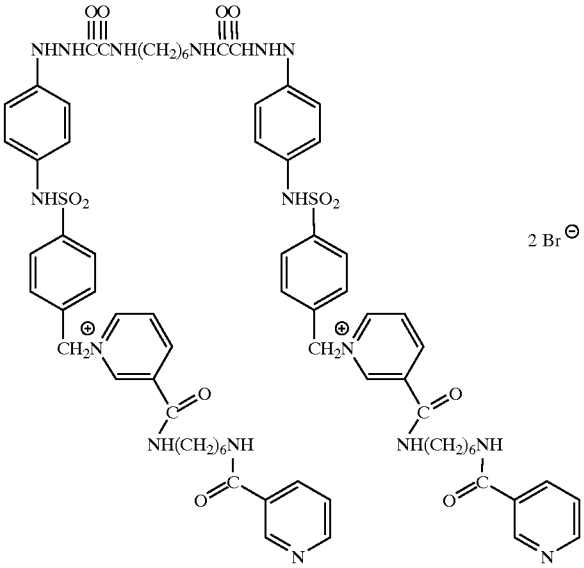
I-19
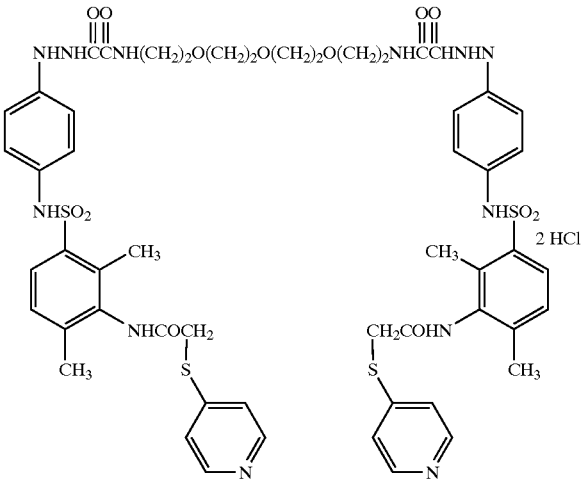
-continued
I-20
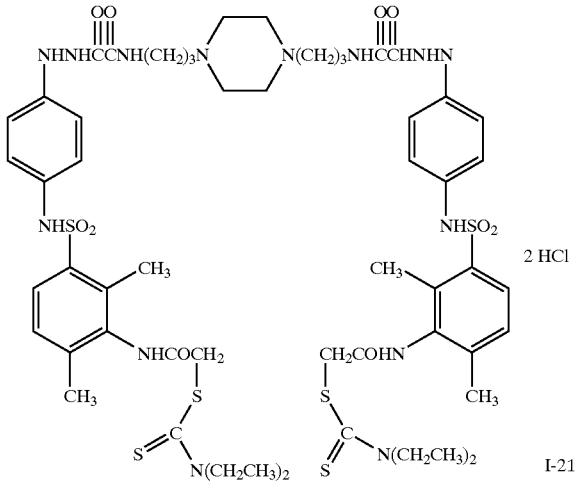
I-21
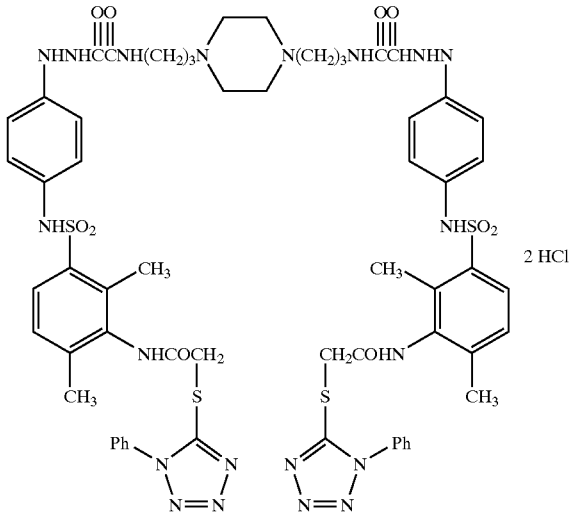
I-22
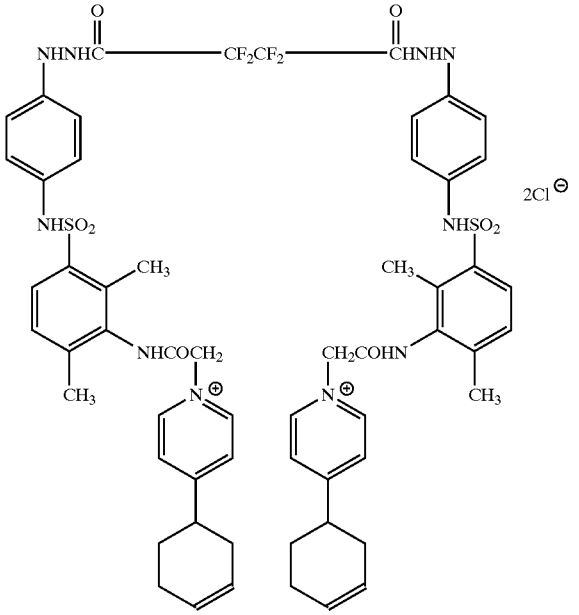

-continued
I-23
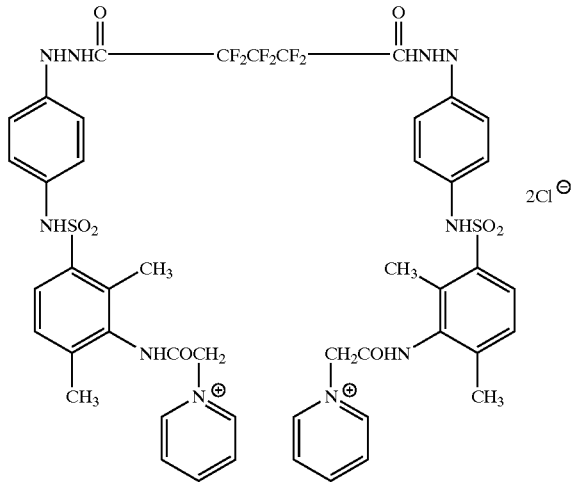
I-24
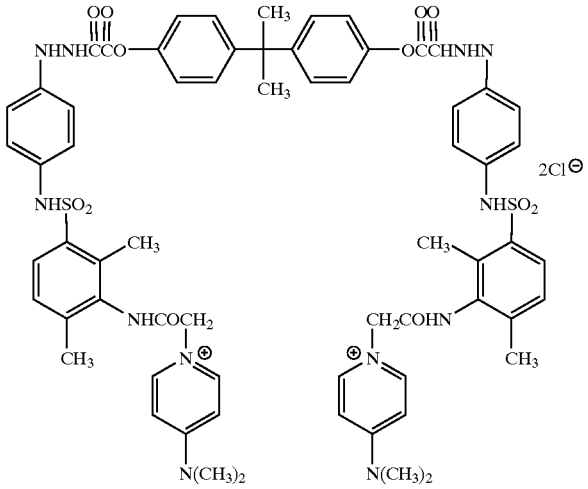
I-25
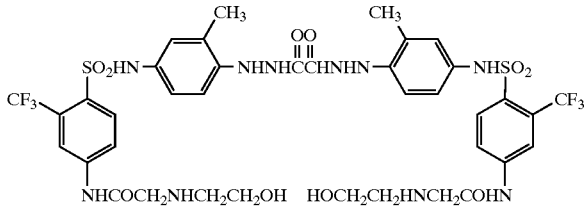
I-26
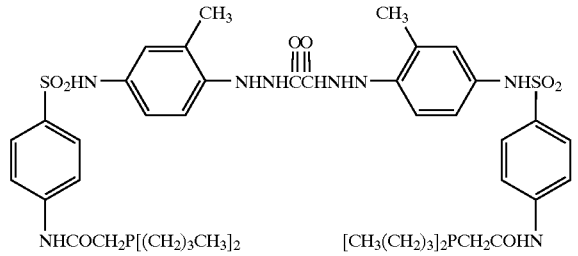
-continued
I-27
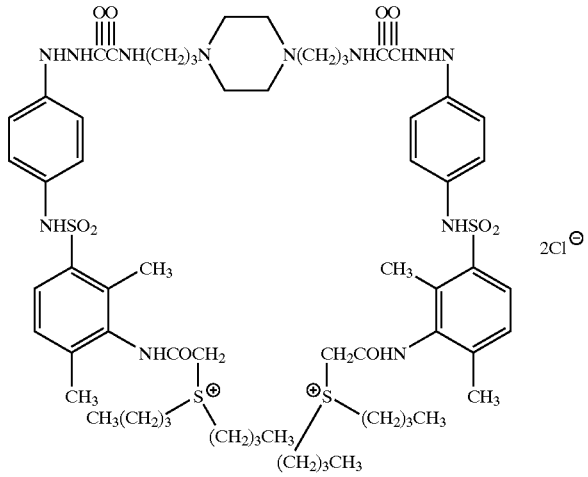
I-28
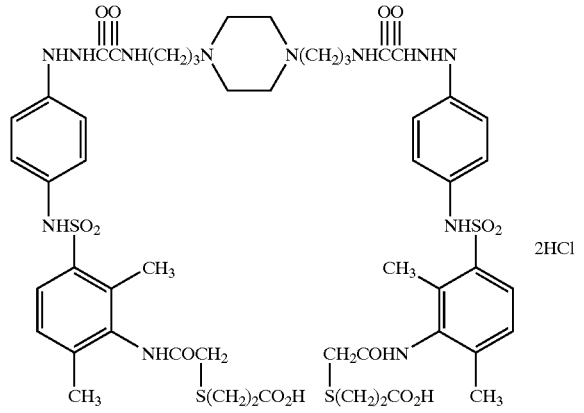
I-29
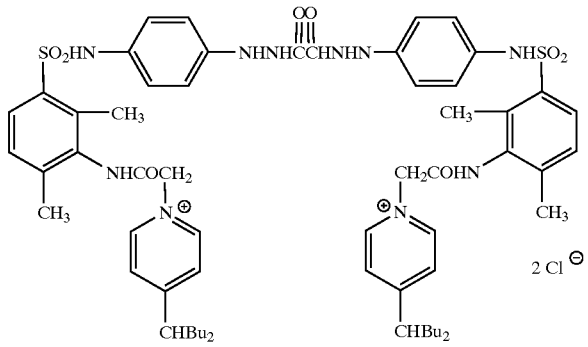

-continued
I-30
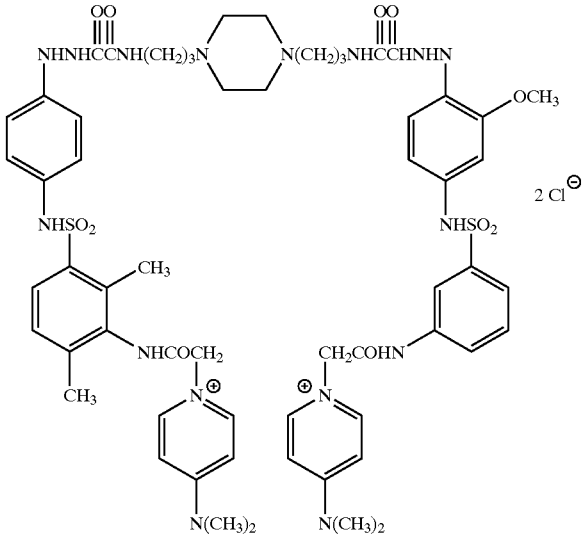
I-31
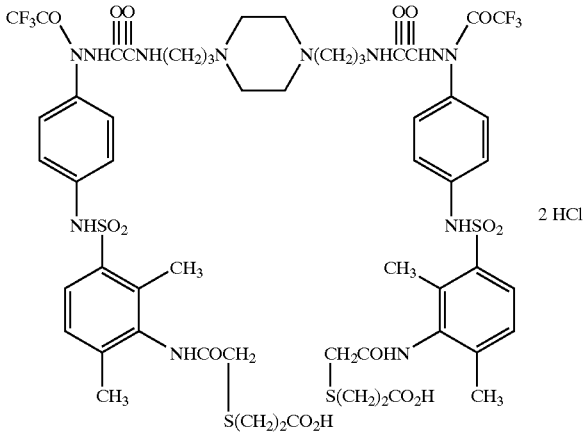
I-32
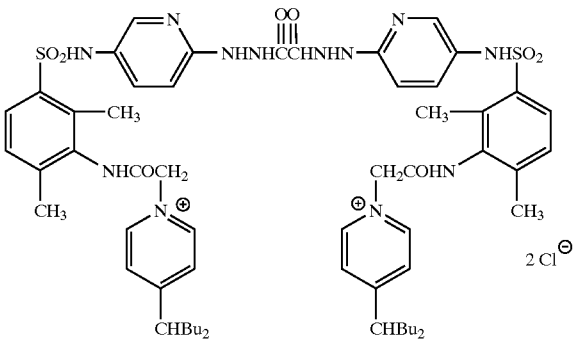
-continued
I-33
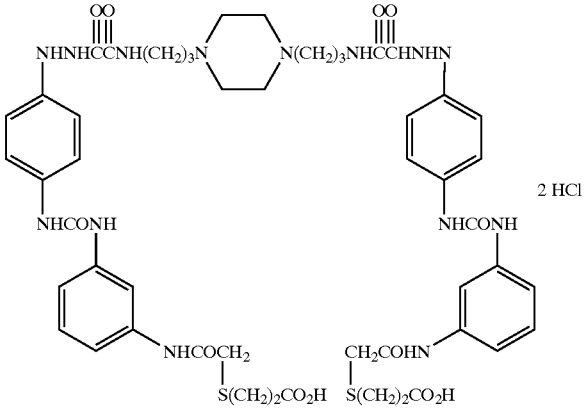
I-34
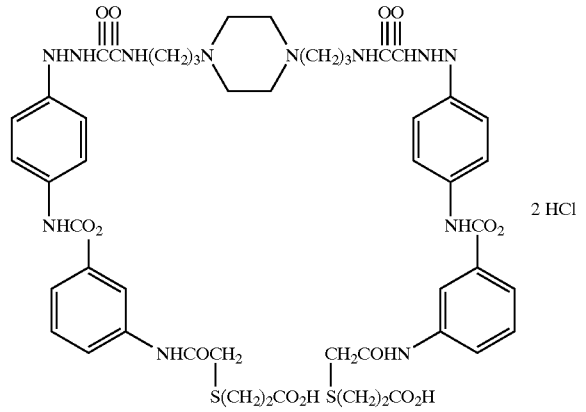
I-35
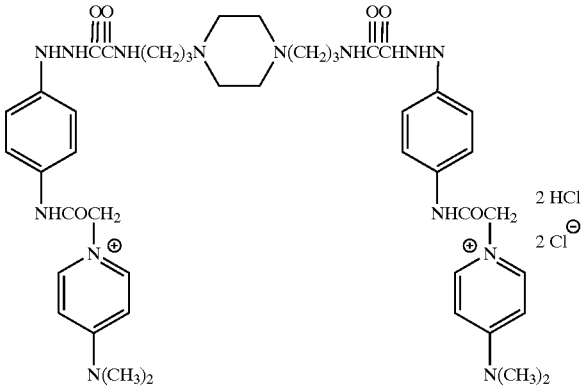

-continued

I-36

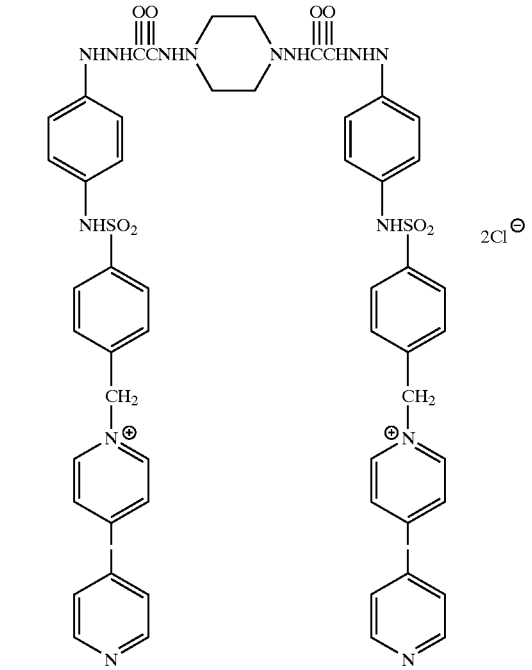

I-37

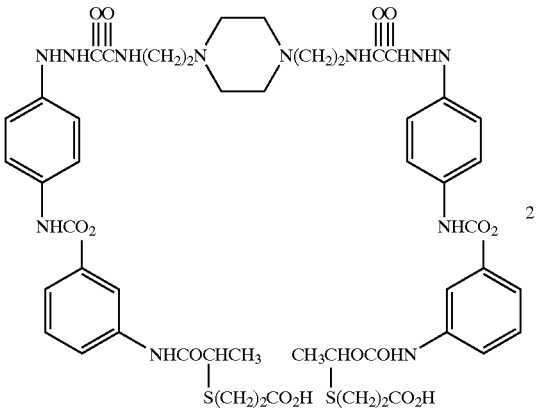

I-38

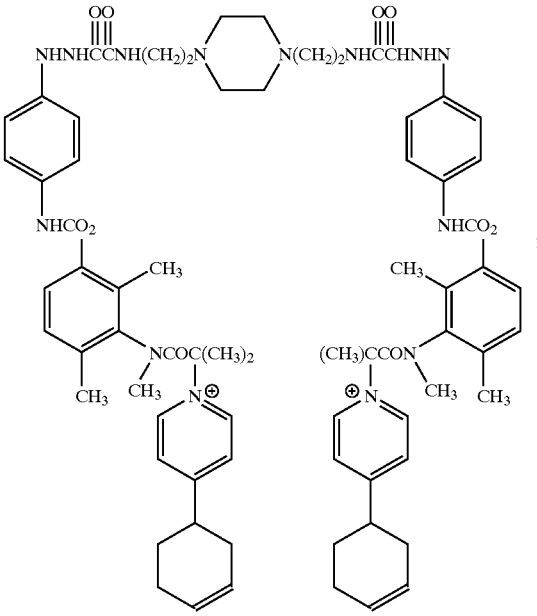

-continued

I-39

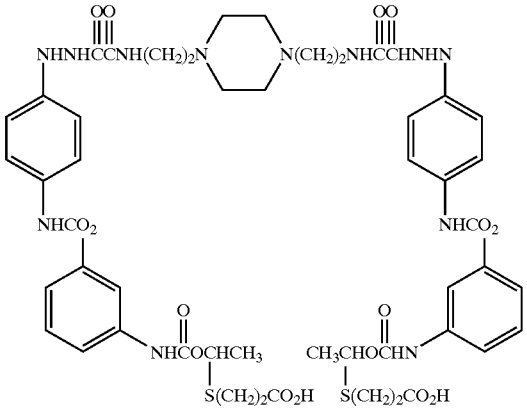

I-40

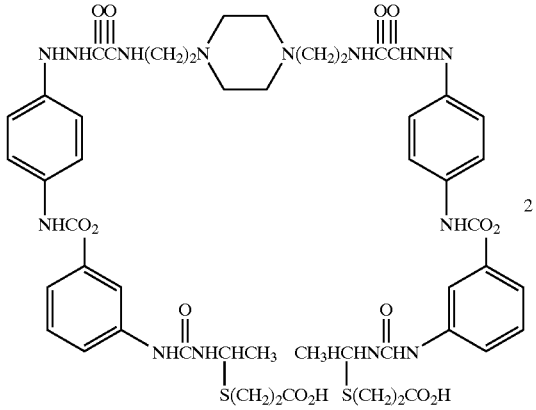

The photographic material of the invention may also contain a booster compound to enhance the ultrahigh contrast and to promote activity. Alternatively the booster compound can be present in the developer solution.

One class of such boosters are amines which (1) comprise at least one secondary or tertiary amino group, and (2) have an n-octanol/water partition coefficient (log P) of at least one, preferably at least three, and most preferably at least four, log P being defined by the formula:

$$\log P = \log \frac{[X_{octanol}]}{[X_{water}]}$$

wherein

X is the concentration of the amino compound.

Preferably such an amine contains within its structure a group comprising at least three repeating ethyleneoxy units as described in U.S. Pat. No. 4,975,354. These units are preferably directly attached to the nitrogen atom of a tertiary amino group.

Included within the scope of the amino compounds which may be utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds having at least 20 carbon atoms.

Preferred amino compounds for inclusion in photographic materials of the invention are bis-tertiary-amines which have a partition coefficient of at least three and a structure represented by the formula:

$$R^1R_2N—(CH_2CH_2O)_n—CH_2—CH_2—NR^3R_4$$

wherein n is an integer from 3 to 50, and more preferably 10 to 50;

$R^1$, $R_2$, $R_3$ and $R^4$ are, independently, alkyl groups of 1 to 8 carbon atoms, or $R_1$ and $R^2$ taken together represent the atoms necessary to complete a heterocyclic ring, and/or $R^3$ and $R^4$ taken together represent the atoms necessary to complete a heterocyclic ring.

A particularly preferred booster for use in photographic materials of the invention or in the developer therefor is the booster B1 wherein in the above formula $R_1$, $R^2$, $R^3$ and $R^4$ are each n-propyl groups and n is 14, i.e. the structure (B1)

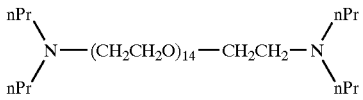

Another preferred group of amino compounds are bis-secondary amines which have a partition coefficient of at least three and a structure represented by the formula:

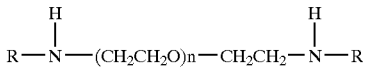

wherein n is an integer from 3 to 50, and more preferably 10 to 50, and each R is, independently, a linear or branched, substituted or unsubstituted, alkyl group of at least 4 carbon atoms.

Particular amines suitable as booster compounds are listed in EP-A-0 364 166.

Other types of boosters are described in U.S. Pat. No. 5,744,279 as having one of the formulae:

$$Y((X)_n\text{-}A\text{-}B)_m \quad (a)$$

wherein

Y is a group which adsorbs to silver halide,

X is a divalent linking group composed of hydrogen, carbon, nitrogen and sulphur atoms, A is a divalent linking group, B is an amino group which may be substituted or an ammonium group of a nitrogen-containing heterocyclic group, m is 1, 2 or 3 and n is 0 or 1, $$R^1R^2N\text{-}R^3\text{-}(X)_n\text{-}SM_x \quad (b)$$

wherein $R_1$ and $R_2$ are each hydrogen or an aliphatic group, or $R_1$ and $R_2$ may together form a ring, $R^3$ is a divalent aliphatic group, X is a divalent heterocyclic ring having at least one nitrogen, oxygen or sulphur atom as heteroatom, n is 0 or 1, $M_x$ is hydrogen or an alkali metal atom, alkaline earth metal atom, a quaternary ammonium, quaternary phosphonium atom or an amidino group; said compound optionally being in the form of an addition salt;

(c) a phosphonium structure as disclosed in U.S. Pat. No. 5,744,279 and as exemplified by the following formula:

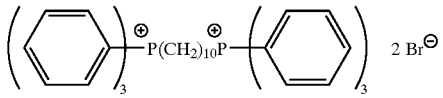

or (d) a pyridinium structure as disclosed in U.S. Pat. No. 5,744,279 as exemplified by the following formula:

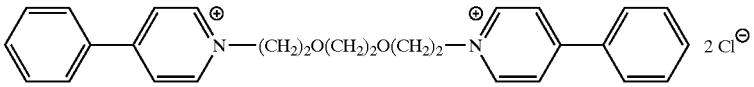

The nucleating agent and optionally the booster compound can be incorporated in the photographic element, for example it can be incorporated in a silver halide emulsion layer. Alternatively it can be present in a hydrophilic colloid layer of the photographic element, preferably a hydrophilic layer which is coated to be adjacent to the emulsion layer in which the effects of the nucleating agent are desired. It can however be present in the photographic element distributed between or among emulsion and hydrophilic colloid layers, such as undercoating layers, interlayers and overcoating layers.

Typically the nucleating agent may be present in the photographic material in an amount of from about 1 $\mu$mol/m$^2$ to about 100 $\mu$mol/m$^2$, preferably 3 $\mu$mol/m$^2$ to 50 $\mu$mol/m$^2$, more preferably 5 $\mu$mol/m$^2$ to 20 $\mu$mol/m$^2$. Corresponding amounts for the booster are from 0 mol/m$^2$ to about 1 $\mu$mol/m$^2$, preferably 10 $\mu$mol/m$^2$ to 100 $\mu$mol/m$^2$, most preferably 30 $\mu$mol/m$^2$ to 100 $\mu$mol/m$^2$.

The emulsions employed in photographic materials of the invention and the addenda added thereto, the binders, supports etc. may be as described in Research Disclosure Item 36544, September 1994, published by Kenneth Mason Publications, Emsworth, Hants, PO10 7DQ, United Kingdom, which will be identified hereinafter by the term "Research Disclosure."

The hydrophilic colloid may be gelatin or a gelatin derivative, polyvinylpyrrolidone or casein and may contain a polymer. Suitable hydrophilic colloids and vinyl polymers and copolymers are described in Section IX of the Research Disclosure. Gelatin is the preferred hydrophilic colloid. The photographic materials may also contain an overcoat hydrophilic colloid layer which may also contain a vinyl polymer or copolymer located as the last layer of the coating (furthest from the support). It may contain one or more surfactants to aid coatability and may contain some form of matting agent. The vinyl polymer is preferably an acrylic polymer, preferably containing units derived from one or more alkyl or substituted alkyl acrylates or methacrylates, alkyl or substituted alkyl acrylamides, or acrylates or acrylamides containing a sulfonic acid group.

The photographic materials of the invention preferably contain an antihalation layer which may be on either side of the support, preferably on the opposite side of the support from the emulsion layer. In a preferred embodiment an antihalation dye is contained in the hydrophilic colloid underlayer. The dye may also be dissolved in or dispersed in the underlayer. Suitable dyes are listed in the Research Disclosure disclosed above.

The emulsions are preferably chemically sensitised, for example with both sulfur and gold. The latent-image forming grains can be bromoiodide, chlorobromoiodide, bromide, chlorobromide, chloroiodide or chloride, preferably chlorobromide. They should be preferably be spectrally sensitised. More than one type of spectrally sensitised silver halide grain may be present and hence grains sensitised to different spectral regions may be present in the emulsion layer.

The coating may be made by blending two or more emulsion melts containing grains of the required spectral sensitivity, allowing the production of multi-wavelength sensitive products and giving rise to manufacturing cost advantages through both material and inventory reduction. Combining the different emulsion grains within one layer can give improvements in process sensitivity over multilayer graphics nucleated systems, as described in EP-A-0 682 288.

The silver halide grains may be doped with rhodium, ruthenium, iridium or other Group VIII metals either alone or in combination, preferably at levels in the range $10^{-9}$ to $10^{-3}$, preferably $10^{6}$ to $10^{-3}$ mol metal per mole of silver. The grains may be mono- or poly-disperse. The preferred Group VIII metals are rhodium and/or iridium and ammonium pentachlororhodate may conveniently be used.

The present photographic materials are particularly suitable for exposure by red or infra-red laser diodes, light-emitting diodes or gas lasers, e.g. a Helium/Neon or Argon laser.

The light-sensitive silver halide contained in the photographic elements can be processed following exposure to form a visible image by associating the silver halide with an aqueous alkaline medium in the presence of a developing agent contained in the medium or the element. The photographic elements of this invention can be processed in conventional developers as opposed to specialised developers sometimes employed in conjunction with lithographic photographic elements to obtain very high contrast images. When the photographic elements contain incorporated developing agents the elements can be processed in the presence of an activator, which can be identical to the developer in composition, but otherwise lacking a developing agent. Very high contrast images can be obtained at pH values below 11, preferably in the range of from 10.0 to 10.8, preferably in the range of 10.3 to 10.5 and especially at pH 10.4.

The developers are typically aqueous solutions, although organic solvents, such as diethylene glycol, can also be included to facilitate the solution of organic components. The developers contain one or a combination of conventional developing agents, such as, for example, a polyhydroxybenzene, such as hydroquinone, aminophenol, paraphenylenediamine, pyrazolidone, pyrazolone, pyrimidine, dithionite or hydroxylamine; or ascorbic acid or a related compound thereof, such as sodium erythorbate, which may be in combination with specific para-aminophenols as described in EP-A-793 140.

It is preferred to employ hydroquinone and 3-pyrazolidone developing agents in combination. The pH of the developers can be adjusted with alkali metal hydroxides and carbonates, borax and other basic salts. It is, as previously mentioned, a particular advantage of the present invention that the use of a nucleating agent as described herein reduces the sensitivity of the photographic material to changes in this developer pH.

To reduce gelatin swelling during development, compounds such as sodium sulfate can be incorporated into the developer. Chelating and sequestering agents, such as ethylenediaminetetraacetic acid or its sodium salt, can be present. Generally any conventional developer can be used in the practice of this invention. Specific illustrative photographic developers are disclosed in the Handbook of Chemistry and Physics, $36^{th}$ Edition, under the title "Photographic Formulae" at page 30001 et seq. and in "Processing Chemicals and Formulas." $6^{th}$ Edition, published by Eastman Kodak Company (1963).

The invention will now be described with reference to the following examples which are in no way to be considered as limiting the scope thereof.

EXAMPLES

Example 1

Preparation of Nucleating Agent I-1

All the compounds prepared had infra-red, mass and NMR spectra which were in accordance with pure samples of the desired products.

The synthetic pathway to Nucleating agent I-1 is described in some detail below and illustrates the general method by which other examples wherein there is a linking group L may be prepared.

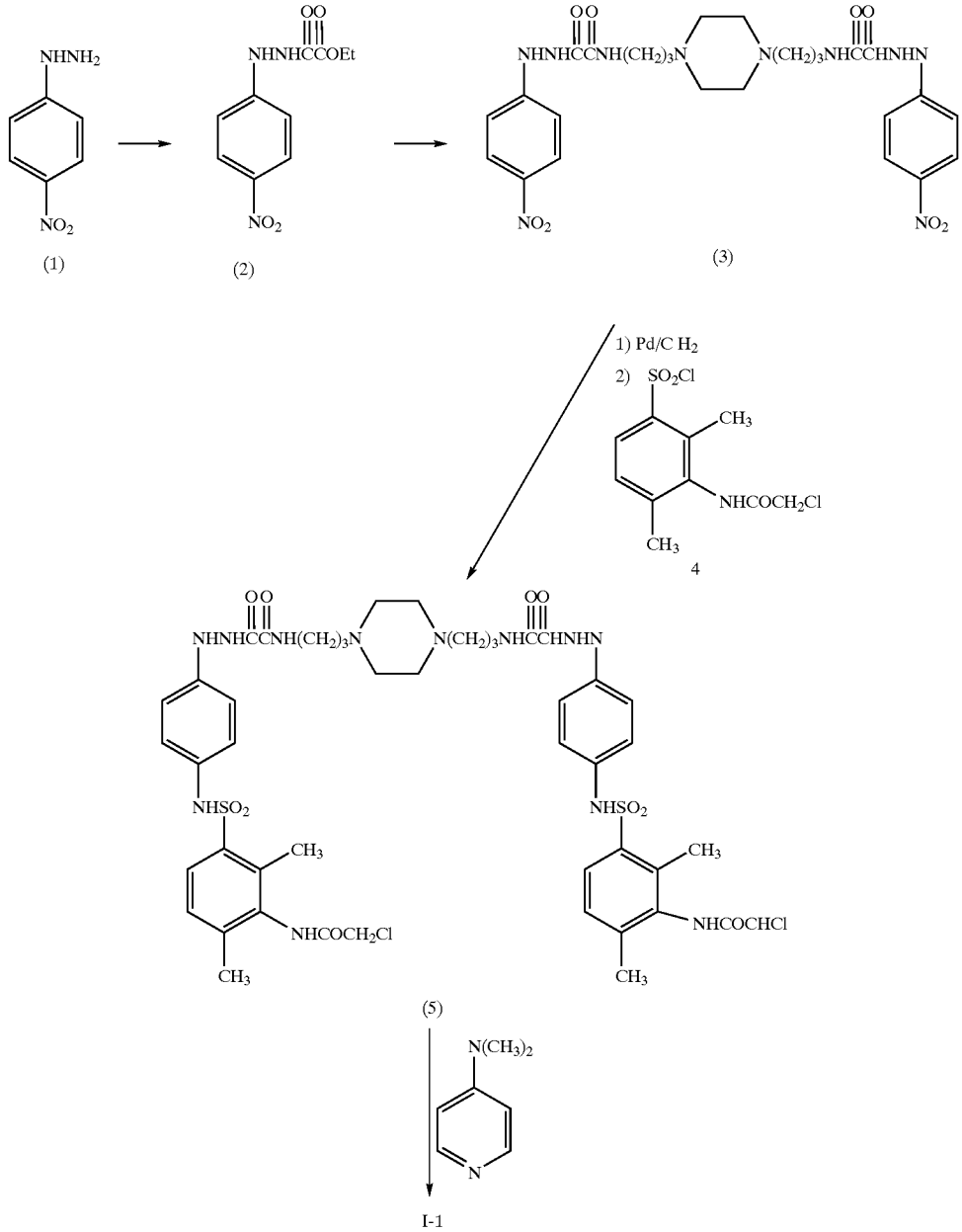

Preparation of Intermediate (2)

To a mixture of 4-nitrophenylhydrazine (1) (110.0 g, stabilized with 10% water, 0.653 mol) and dimethylaniline (83.1 g, 0.685 mol) in ethyl acetate (1.21) ethyl chlorooxoacetate (98.1 g, 0.718 mol) was added dropwise over the course of 2.25 h at 0–5 C. The mixture was left at room temperature overnight. The reaction mixture was warmed to give a solution, washed twice with dilute aqueous hydrochloric acid (2×500 ml, 1.0M) and then with dilute aqueous sodium chloride (2×500 ml, 1.0M). The solution was concentrated in vacuo to about ¼ volume, diluted with heptane (780 ml) and then chilled to ensure complete precipitation of the product. The product was filtered, washed with 30/70 ethyl acetate/heptane mixture, air dried and then dried in a vacuum desiccator. Yield=129.3 g (78%)

Preparation of Intermediate (3)

Intermediate (2) (27.8 g, 0.1 mol) was dissolved in methanol (500 ml) and stirred under nitrogen. 1,4-Bis(3-aminopropyl)piperazine (10.0 g, 0.05 mol) was added and the solution was heated to reflux in a hot oil bath (at 90 C) overnight under a good flow of nitrogen. The stirred solution was allowed to cool slowly to room temperature and filtered. The product was obtained as a dark purple solid. The lumpy solid was crushed and the residue washed well with methanol in the filter funnel. The product was dried in a vacuum desiccator. Yield=28.2 g (92%).

Preparation of Intermediate (4)

Intermediate (4) was prepared according to the method disclosed in U.S. Pat. No 4,988,604 entitled "High-contrast silver halide photographic material containing hydrazide".

Preparation of Intermediate (5)

Intermediate (3) (10.0 g, 0.0163 mole) was dissolved in dimethylacetamide (200 ml) with palladium/carbon catalyst (10%) (1.8 g). The mixture was hydrogenated overnight under 32 atm. pressure of hydrogen. The amine solution was filtered through a bed of Kieselguhr under suction into a Buchner flask containing the solid sulfonyl chloride (4) (9.5 g, 0.032 mol) and a catalytic amount of 4-(dimethylamino) pyridine (50 mg). Nitrogen was bubbled through the mixture which was then allowed to stand overnight. The reaction mixture was filtered under gravity through a fine filter paper to remove a little residual catalyst into a stirred solution of sodium hydrogen carbonate (20 g) in water (2.51). A pinkish-white precipitate appeared which was stirred for 1 h and then filtered, washed with water and dried at the pump. The product was dried in a vacuum desiccator over phosphorus pentoxide. Yield=15.1 g (86%)

Preparation of Nucleating Agent I-1

Intermediate (5) (1.0 g, 0.00093 mol) was dissolved in dimethylacetamide (5 ml) with 4-(dimethylamino)pyridine (0.57 g, 0.00465 mol) under nitrogen and heated to 70 C in an oil bath with stirring for 1 h. The reaction mixture was allowed to cool to room temperature under nitrogen and then poured into di-isopropyl ether (0.71) with stirring. A pink coloured solid formed which was filtered, washed with di-isopropyl ether and dried in vacuo in a desiccator overnight. Methanol (30 ml) was added to the product to dissolve it and the solution poured into di-isopropyl ether (700 ml) with stirring. A solid formed and this was filtered and washed with di-isopropyl ether. The pink coloured solid was dried overnight in the vacuum desiccator. Yield=0.55 g (45%)

It can be seen from the above preparation of nucleating agent I-1 that, by using a 2.5-fold excess of 4-(dimethylamino)pyridine, the reaction may be driven rapidly to completion within 1 h to give a product of consistent composition, i.e. the reaction is robust. In contrast, in the preparation of the comparison nucleating agent C-2 (U.S. Pat. No. 6,228,566) the reaction time to completion was 24 h at 70 C. This extended reaction time results in the formation of breakdown products and thereby a product whose composition is variable and therefore the reaction is not so robust.

Example 2

Preparation of Nucleating Agent I-29

All the compounds prepared had infra-red, mass and NMR spectra which were in accordance with pure samples of the desired products.

The synthetic pathway to Nucleating agent I-29 is described in some detail below. It illustrates the general method by which other such examples wherein there is no linking group L may be prepared.

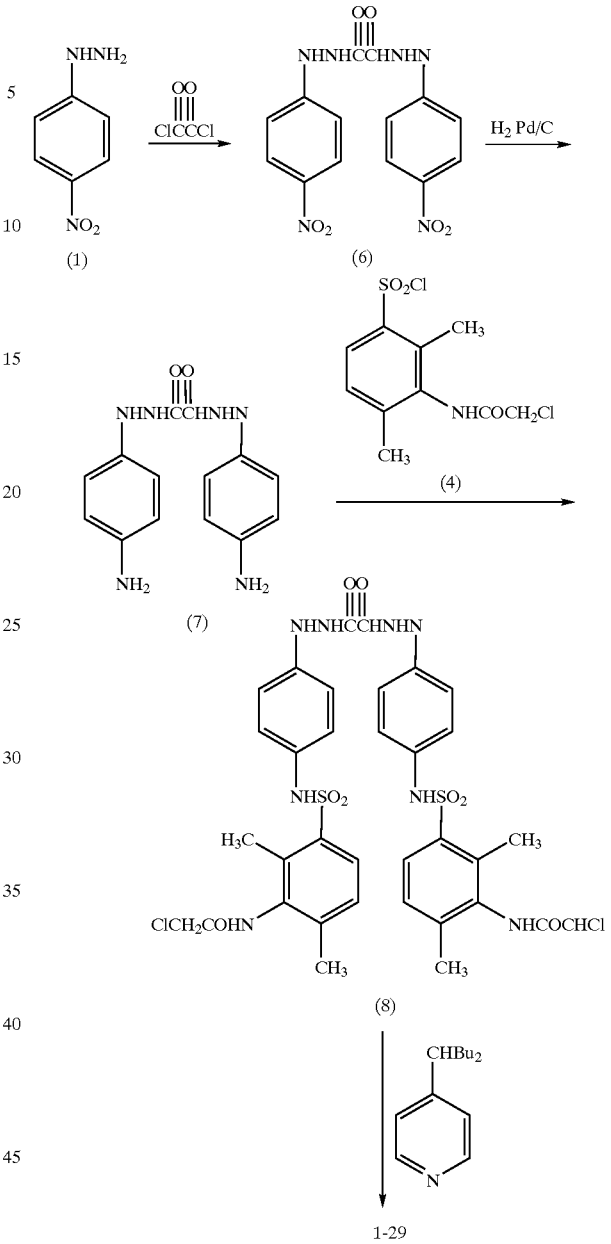

Preparation of Intermediate (6)

4-Nitrophenylhydrazine (1) (40.0 g, 0.261 mol) was dissolved in a mixture of dry tetrahydrofuran (THF) (500 ml) and dry dimethylforrnamide (50 ml). N,N-Dimethylaniline (31.7 g, 0.261 mol) was added and the dark brown solution was stirred under nitrogen in an ice/acteone bath. Oxalyl chloride (16.6 g, 0.13 mol) in dry THF (50 ml) was added in a thin stream and the mixture stirred for 2 h during which time it was allowed to warm to room temperature. Some effervescence was noted. A further quantity of oxalyl chloride (15.0 g, 0.118 mol) in THF (50 ml) was added and the mixture allowed to stand overnight. A mass spectrum indicated that there was still starting hydrazine (1) present, so a further quantity of oxalyl chloride (10.0 g, 0.079 mol) in THF (30 ml) was added in a dropwise fashion. The mixture was allowed to stand overnight. The mixture was filtered and the THF removed on the rotary evaporator. The residual solution was poured with stirring into ice/water (31) containing concentrated hydrochloric acid (10 ml). A brownish yellow solid precipitated and this was stirred for 10 min, filtered and washed with water. The product was allowed to air-dry over the weekend. Yield=35.0 g (75%)

Preparation of Intermediate (7)

Compound (6) (20.0 g, 0.056 mol) was dissolved in dimethyl-acetamide (350 ml) with palladium on carbon (10%) catalyst (4 g) and hydrogenated at 32 atm overnight. The solution was filtered through Kieselguhr and taken directly on to the next stage.

Preparation of Intermediate (8)

Intermediate (7) in solution in dimethylacetamide (500 ml) from the hydrogenation was stirred at room temperature under nitrogen. The sulfonyl chloride (4) (33.2 g, 0.112 mol) was added portionwise, followed by Huenigs base (14.4 g, 0.112 mol). The solution was stirred overnight. A further portion of the sulfonyl chloride was added (1.7 g) and the mixture left standing over the weekend. The solution was poured into a mixture of water (31) and concentrated hydrochloric acid (20 ml) and the resulting solid filtered and washed with water. The product was the slurried in concentrated sodium hydrogen carbonate solution (31), filtered and washed with water. The solid was air dried overnight, slurried in ethanol (500 ml), filtered, boiled up in acetonitrile (500 ml), stirred for several hours and filtered. The product was dried in vacuo. Yield=30.4 g (66%)

Preparation of Nucleating Agent I-29

Intermediate (8) (2.0 g, 0.00244 mol) was dissolved in dimethylacetamide (10 ml) with 4-(1-butylpentyl)pyridine (2.5 g, 0.0122 mol) under nitrogen and heated to 70 C in an oil bath with stirring for 2 h. The mixture was allowed to cool to room temperature under nitrogen and then poured into di-isopropyl ether (1.41) with stirring. A tan-coloured precipitate formed that was filtered, washed with di-isopropyl ether and dried in vacuo in a desiccator. The product was redissolved in methanol (80 ml) and added slowly with stirring to di-isopropyl ether (1,600 ml). A colloidal precipitate formed and this was stirred for several minutes and then filtered. The product was washed with di-isopropyl ether and dried in a vacuum desiccator. Yield=1.9 g (63%)

It can be seen from the above preparation of nucleating agent I-29 that, again, by using a 2.5-fold excess of 4-(1-butylpentyl)pyridine the reaction may be driven rapidly to completion within 2 h to give a product of consistent composition, i.e. the reaction is robust, in contrast to the preparation described in U.S. Pat. No. 6,228,566.

Example 3

Preparation and Evaluation of Coatings Incorporating Nucleating Agent I-1 and Comparison Nucleating Agent C-1 and C-2

The comparison nucleating agent C-1 is the monomeric hydrazide analogue of the dimeric nucleating agent I-1 and the comparison nucleating agent C-2 is the differently linked dimeric analogue, as in U.S. Pat. No. 6,228,566.

C-1

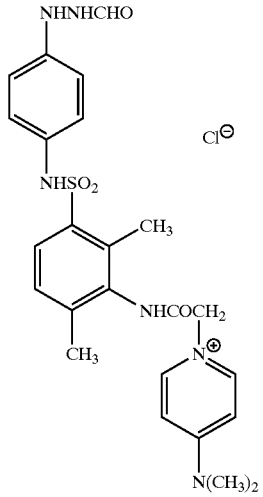

C-2

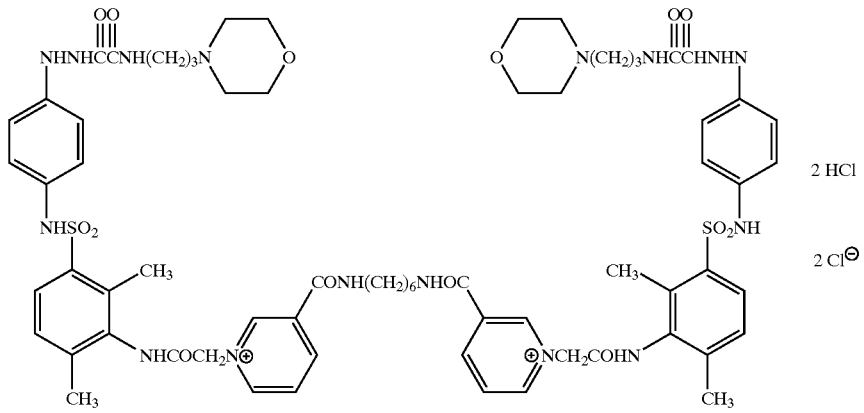

The nucleating agent I-1 and comparison nucleating agents, C-1 and C-2 were individually dissolved in water and separately mixed with a gelatin binder for coating over a red-sensitized silver chlorobromide photographic emulsion on a transparent ESTAR™ support carrying an antihalation pelloid backing layer. A protective gelatin supercoat layer (1.0 g/m$^2$ gelatin), which also contained matte beads and surfactants to aid coatability, was applied over the nucleating agent layer.

The nucleating agents were incorporated at a level of 0.538 mmol/m$^2$ and the layer also contained a nucleation 'booster', compound (B1), at 45 mg/m$^2$ and gelatin at 0.65 g/m$^2$.

(B1)

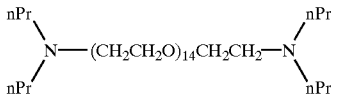

The emulsion layer contained 3.3 g Ag/m$^2$ of a 70/30 silver chlorobromide cubic monodispersed emulsion (0.16 μm edge length) uniformly doped with ammonium pentachlororhodate at $4.4\times10^{-7}$ mol/Ag mol and dipotassium hexachloroiridate at $6\times10^{-7}$ mol/Ag mol. The emulsion was chemically sensitized with sulfur and gold and was spectrally sensitized with 350 mg/Ag mol of sensitizing dye (S1).

(S1)

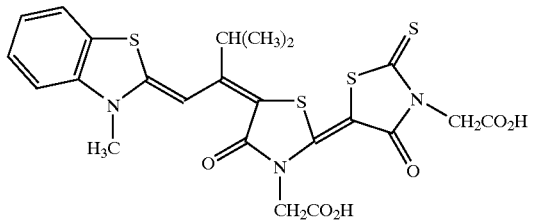

Various addenda to control photographic performance were included in the emulsion layer, namely 2-mercaptomethyl-5-carboxy-4-hydroxy-6-methyl-1,3,3a,7-tetraazaindene (644 mgAg/mol); 2-mercaptomethyl-4-hydroxy-6-methyl- 1,3,3 a,7-tetraazaindene (100 mgAg/mol); 1-(3-acetoamidophenyl)-5-mercaptotetrazole (20 mgAg/mol); 4-(2,3-dihydro-2-thioxo)-4'-thiazoloacetic acid (53 mgAg/mol) and 4,5-dihydroxy-1,3-benzenedisulfonic acid, disodium salt (2.39 mgAg/mol). The layer also contained gelatin (2.65 g/m$^2$) and a methyl acrylate latex (0.58 g/m$^2$)

A comparison coating containing no nucleating agent but otherwise identical to those described above was prepared in the same way.

Sample strips from all coatings were given a stepped red light exposure and processed using either KODAK™ RA 2000 developer or a similar developer, DEV AA, wherein the hydroquinone developing agent had been replaced with sodium erythorbate, in accordance with the formulation below.

A range of development times (20s, 30s, 40s) was used with both developers. Subsequently, the pH of the developer solutions was reduced from 10.53 to 10.30 by the addition of concentrated sulfuric acid, and these modified solutions were used to process further sets of exposed coating strips. Only one development time (30s) was used with these solutions. Sensitometric curves obtained from these coatings were compared to assess the relative performance of each coating.

An appropriate parameter to use to compare the relative efficiency of nucleation is the average contrast (γ), defined as the gradient between two points on the sensitometric curve, respectively 1.5 and 2.5 density units higher than $D_{min}$. Calculated values for this parameter, derived from the measured curves for each coating, are listed in TABLES 1 and 2 below. Figures for $D_{min}$ and relative speed, Sp 0.6 (which is the toe speed measured as the relative logE exposure required to produce a density of 0.6 above $D_{min}$) are also included in the Tables. Subtraction of the contrast values in column 3 of the Tables from those in column 4 gives the increase (or decrease) in contrast generated by the change in developer pH. These figures are shown in column 7 [Δ(pH)]. Similarly, column 8 [Δ(t)] shows the change in contrast associated with doubling the development time at pH 10.53 (i.e. the difference between the values in columns 5 and 6).

| DEV AA (1 l of 1:2 at a 1:2 dilution) | |
|---|---|
| Sodium metabisulfite | 7.60 g |
| Sodium bromide | 3.80 g |
| Pentetic acid pentasodium salt | 10.00 g |
| Polymaleic acid | 3.25 g |
| Benzotriazole | 0.28 g |
| Phenylmercaptotetrazole | 0.03 g |
| Diethylene glycol | 55.00 g |
| Potassium carbonate | 58.80 g |
| Sodium erythorbate | 43.00 g |
| Hydroxymethylmethylphenylpyrazolidone | 2.25 g |
| Potassium hydroxide 50% | 4.67 g |
| pH | 10.44 |

TABLE 1

| | RA2000 Developer | | | | | | |
|---|---|---|---|---|---|---|---|
| Nucl. agent | pH<br>Time (s) | 10.30<br>30 | 10.53<br>30 | 10.53<br>20 | 10.53<br>40 | Δ<br>(pH) | Δ<br>(t) |
| — | $D_{min}$ | 0.023 | 0.024 | 0.023 | 0.025 | −0.27 | −0.18 |
| | Sp.(0.6) | 0.44 | 0.44 | 0.39 | 0.44 | | |
| | γ | 6.95 | 6.68 | 7.05 | 6.87 | | |

TABLE 1-continued

| | RA2000 Developer | | | | | | |
|---|---|---|---|---|---|---|---|
| Nucl. agent | pH<br>Time (s) | 10.30<br>30 | 10.53<br>30 | 10.53<br>20 | 10.53<br>40 | Δ<br>(pH) | Δ<br>(t) |
| C-1 | $D_{min}$ | 0.022 | 0.023 | 0.022 | 0.025 | 5.02 | 4.48 |
| | Sp.(0.6) | 0.51 | 0.57 | 0.53 | 0.60 | | |
| | γ | 15.72 | 20.74 | 17.6 | 22.08 | | |
| I-1 (Inv.) | $D_{min}$ | 0.023 | 0.023 | 0.024 | 0.025 | 3.16 | 4.19 |
| | Sp.(0.6) | 0.56 | 0.63 | 0.57 | 0.68 | | |
| | γ | 20.83 | 23.99 | 23.28 | 27.47 | | |
| C-2 | $D_{min}$ | 0.022 | 0.023 | 0.022 | 0.024 | −3.98 | 14.51 |
| | Sp.(0.6) | 0.53 | 0.59 | 0.53 | 0.62 | | |
| | γ | 27.64 | 23.66 | 21.46 | 35.97 | | |

TABLE 2

| | DEV AA Developer | | | | | | |
|---|---|---|---|---|---|---|---|
| Nucl. agent | pH<br>Time (s) | 10.30<br>30 | 10.53<br>30 | 10.53<br>20 | 10.53<br>40 | Δ<br>(pH) | Δ<br>(t) |
| — | $D_{min}$ | 0.024 | 0.023 | 0.023 | 0.024 | 0.65 | 0.42 |
| | Sp.(0.6) | 0.41 | 0.41 | 0.38 | 0.44 | | |
| | γ | 6.24 | 6.89 | 6.28 | 6.7 | | |
| C-1 | $D_{min}$ | 0.021 | 0.024 | 0.021 | 0.023 | 5.78 | 8.23 |
| | Sp.(0.6) | 0.47 | 0.48 | 0.48 | 0.52 | | |
| | γ | 10.58 | 16.36 | 9.88 | 18.11 | | |
| I-1 (Inv.) | $D_{min}$ | 0.022 | 0.024 | 0.022 | 0.023 | 5.48 | 7.92 |
| | Sp.(0.6) | 0.49 | 0.52 | 0.49 | 0.54 | | |
| | γ | 12.05 | 17.53 | 13.94 | 21.86 | | |
| C-2 | $D_{min}$ | 0.021 | 0.022 | 0.021 | 0.024 | 6.36 | 8.00 |
| | Sp.(0.6) | 0.50 | 0.49 | 0.50 | 0.56 | | |
| | γ | 11.17 | 17.53 | 15.01 | 23.01 | | |

The figures in the Tables show that for both developer solutions and every development condition the coatings containing the nucleating agent I-1 used in this invention and the comparison nucleating agent C-1 and C-2 gave significantly higher contrast than the blank coating containing no nucleating agent, indicating that all compounds are effective nucleating agents.

Moreover, in every development condition, the nucleating agent I-1 gave higher speed and contrast than was obtained from the comparison nucleating agent C-1, indicating that the efficiency of nucleation by I-1 is superior to that by the comparison nucleating agent. Furthermore the speed and contrast of the nucleating agent I-1 was comparable and in most cases superior to those values for C-2, whilst at the same time it could be synthesised more rapidly and with a more consistent constitution than could C-2.

Another advantage shown by the nucleating agents used in this invention is illustrated by the Δ(pH) and Δ(t) figures in the Tables. It is well-recognised that more active development generally increases the speed and contrast of the final image, but it is noteworthy that the nucleating agent I-1 appears to be more tolerant of variability in development activity than either of the comparison nucleating agents (C-1) and C-2, since it shows a smaller change with respect to both developer pH and time of development.

The present invention has been described in detail with reference to preferred embodiments. It will be understood by those skilled in the art that variations and modifications can be made within the spirit and scope of the invention.

What we claim is:

1. An ultrahigh contrast photographic material comprising a support bearing a silver halide emulsion layer, containing at least one hydrazide nucleating agent in the emulsion layer and/or a hydrophilic colloid layer, characterised in that the nucleating agent has the formula (I):

(I)

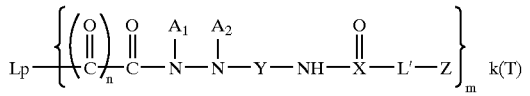

wherein each $A_1$ and each $A_2$ is independently selected from the class consisting of a hydrogen atom, an unsubstituted or substituted acyl group and an alkyl- or aryl-sulfonyl group;

each Y is independently selected from the class consisting of an unsubstituted or substituted aryl or heterocyclic ring or ring system;

each X is independently selected from the class consisting of S═O, C, C—NH and C—O;

each L' is independently selected from the class consisting of an unsubstituted or substituted alkylene group and an unsubstituted or substituted aryl or heterocyclic ring or ring system, linked to Z via an unsubstituted or substituted alkylene group, either directly or via a group selected from the class consisting of $NR_1CO$—, $NR_1CONR_2$—, $OCONR_1$— or $NR_1COO$—, wherein $R_1$ and $R_2$ are independently selected from the class consisting of a hydrogen atom and an unsubstituted or substituted alkyl group;

each Z is independently selected from an unsubstituted or substituted group, ring or ring system attached via a heteroatom selected from the class consisting of sulfur, nitrogen, oxygen or phosphorus;

each L is independently a divalent, trivalent or tetravalent linking group;

p and each n are independently 0 or 1 k is an integer from 0 to 8;

and m is an integer from 2 to 4 provided that when p is 0, n is 0 and m is 2;

when p is 1, n is 0 or 1 and m is 2, 3 or 4; and

T is a counterion or a salt forming acid.

2. A photographic material as claimed in claim 1 wherein each $A_1$ and each $A_2$ is independently a hydrogen atom.

3. A photographic material as claimed in claim 1 wherein each Y is independently an unsubstituted phenyl group or a phenyl group substituted with an alkylthio, alkylsulfonamido, alkyl, alkoxy or trifluoromethyl group.

4. A photographic material as claimed in claim 1 wherein each X is independently S═O or C.

5. A photographic material as claimed in claim 4 wherein when X is S═O, L' is an unsubstituted or substituted phenyl ring linked to Z via a methylene group, either directly or via a NHCO group.

6. A photographic material as claimed in claim 4 wherein when X is C, L' is an unsubstituted or substituted alkylene group.

7. A photographic material as claimed in claim 1 wherein each Z forms an independently an unsubstituted or substituted group, ring or ring system attached via a nitrogen or sulfur atom.

8. A photographic material as claimed in claim 7 wherein each Z is independently an unsubstituted or substituted pyridyl group.

9. A photographic material as claimed in claim 1 wherein the linking group L is an unsubstituted or substituted aromatic, alkylene, polyalkylene or polyalkylene oxide group, or an unsubstituted or substituted alkylene or polyalkylene group separated by one or more heteroatoms selected from nitrogen, oxygen and sulfur, wherein the groups within L may also be separated from each other by one or more unsubstituted or substituted alkylene, polyalkylene, aryl or heterocyclic groups, and L may include, linked to each carbonyl group, a terminal oxygen atom or a group NR', wherein R' is a hydrogen atom or an unsubstituted or substituted alkyl group.

10. A photographic material as claimed in claim 9 wherein the linking group L is selected from —$NH(CH_2)_2NH$—, —$NH(CH_2)_6NH$—, —$(CF_2)_2$, —$(CF_2)_3$, —$NH(CH_2)_2O(CH_2)_2O(CH_2)_2O(CH_2)_2NH$—, —$OC_6H_4C(CH_3)_2C_6H_4O$— and —$NH(CH_2)_n$-piperidino-$(CH_2)_nNH$—, wherein n is 0 to 4.

11. A photographic material as claimed in claim 1 wherein p and each n are 0 and m is 2.

12. A photographic material as claimed in claim 1 wherein p is 1 and each n is independently 0 or 1 and m is 2, 3 or 4.

13. A photographic material as claimed in claim 1 wherein the nucleating agent of formula (I) has the formula:

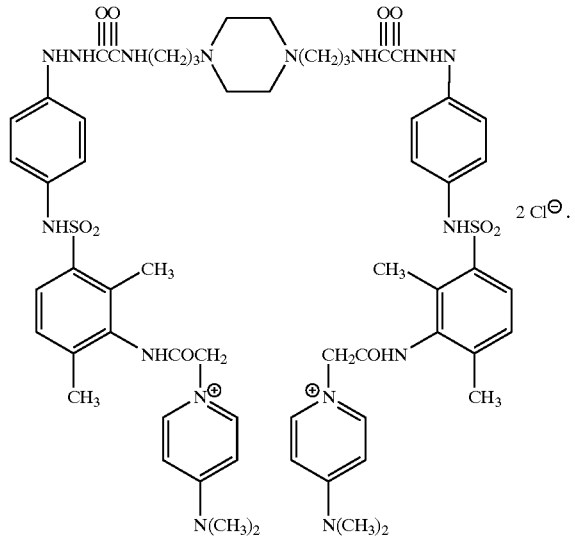

14. A photographic material as claimed in claim 1 wherein the nucleating agent of formula (I) has the formula:

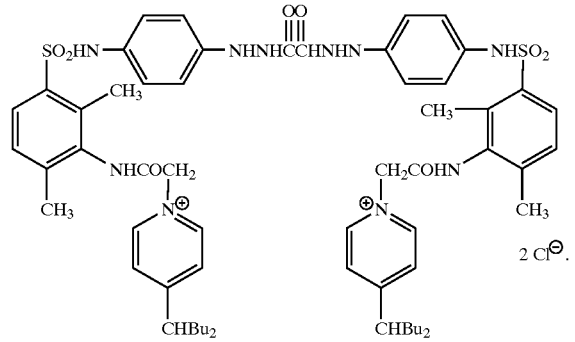

15. A photographic material as claimed in claim 1 wherein the nucleating agent is present in the photographic material in an amount of from about 5 $\mu$mol/$m^2$ to about 20 $\mu$mol/$m^2$.

16. A photographic material as claimed in claim 1 which also contains in the emulsion layer or a hydrophilic colloid layer, a booster compound.

17. A photographic material as claimed in claim 16 wherein the booster is present in the photographic material in an amount of from about 30 $\mu$mol/$m^2$ to about 100 $\mu$mol/$m^2$.

18. A process of forming a photographic image having ultrahigh contrast which comprises imagewise exposing a photographic material comprising a support bearing a silver halide emulsion layer and processing it with an alkaline developer solution, characterised in that it is developed in the presence of a nucleating agent of formula (I), (I)

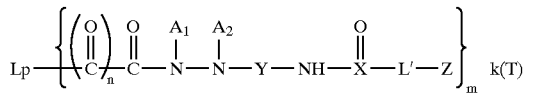

wherein each $A_1$ and each $A_2$ is independently selected from the class consisting of a hydrogen atom, an unsubstituted or substituted acyl group and an alkyl- or aryl-sulfonyl group;

each Y is independently selected from the class consisting of an unsubstituted or substituted aryl or heterocyclic ring or ring system;

each X is independently selected from the class consisting of S═O, C, C—NH and C—O;

each L' is independently selected from the class consisting of an unsubstituted or substituted alkylene group and an unsubstituted or substituted aryl or heterocyclic ring or ring system, linked to Z via an unsubstituted or substituted alkylene group, either directly or via a group selected from the class consisting of $NR_1CO$—, $NR_1CONR_2$—, $OCONR_1$— or $NR_1COO$—, wherein $R_1$ and $R_2$ are independently selected from the class consisting of a hydrogen atom and an unsubstituted or substituted alkyl group;

each Z is independently selected from an unsubstituted or substituted group, ring or ring system attached via a heteroatom selected from the class consisting of sulfur, nitrogen, oxygen or phosphorus;

each L is independently a divalent, trivalent or tetravalent linking group;

p and each n are independently 0 or 1 k is an integer from 0 to 8;

and m is an integer from 2 to 4 provided that when p is 0, n is 0 and m is 2;

when p is 1, n is 0 or 1 and m is 2, 3 or 4; and

T is a counterion or a salt forming acid.

* * * * *